US005715365A

United States Patent [19]

Griffin et al.

[11] Patent Number: 5,715,365

[45] Date of Patent: Feb. 3, 1998

[54] ESTIMATION OF EXCITATION PARAMETERS

[75] Inventors: Daniel Wayne Griffin, Hollis, N.H.; Jae S. Lim, Winchester, Mass.

[73] Assignee: Digital Voice Systems, Inc., Burlington, Mass.

[21] Appl. No.: 222,119

[22] Filed: Apr. 4, 1994

[51] Int. Cl.[6] ..... G10L 3/02

[52] U.S. Cl. ..... 395/2.23; 395/2.32

[58] Field of Search ..... 395/2.14, 2.17, 395/2.23, 2.09, 2.32; 381/36–39

[56] References Cited

U.S. PATENT DOCUMENTS

| | | | |
|---|---|---|---|
| 3,706,929 | 12/1972 | Robinson et al. | 325/15 |
| 3,975,587 | 8/1976 | Dunn et al. | 179/1 SA |
| 3,982,070 | 9/1976 | Flanagan | 179/1 SM |
| 3,995,116 | 11/1976 | Flanagan | 179/1 SM |
| 4,004,096 | 1/1977 | Bauer et al. | 179/1 SC |
| 4,015,088 | 3/1977 | Dubnowski et al. | 179/1 SC |
| 4,081,605 | 3/1978 | Kitawaki et al. | 179/1 |
| 4,091,237 | 5/1978 | Wolniwsky et al. | 395/2.16 |
| 4,282,405 | 8/1981 | Taguchi | 179/1 SC |
| 4,441,200 | 4/1984 | Fette et al. | 381/36 |
| 4,443,857 | 4/1984 | Albarello | 364/513.5 |
| 4,509,186 | 4/1985 | Omura et al. | 395/2.17 |
| 4,618,982 | 10/1986 | Horvath et al. | 381/36 |
| 4,622,680 | 11/1986 | Zinser | 375/25 |
| 4,637,046 | 1/1987 | Sluijter et al. | 381/49 |
| 4,720,861 | 1/1988 | Bertrand | 381/36 |
| 4,791,671 | 12/1988 | Willems | 381/49 |
| 4,797,926 | 1/1989 | Bronson et al. | 381/36 |
| 4,829,574 | 5/1989 | Dewhurst et al. | 381/41 |
| 4,879,748 | 11/1989 | Picone et al. | 381/49 |
| 5,081,681 | 1/1992 | Hardwick et al. | 381/51 |
| 5,216,747 | 6/1993 | Hardwick et al. | 395/2 |
| 5,226,084 | 7/1993 | Hardwick et al. | 381/41 |
| 5,226,108 | 7/1993 | Hardwick et al. | 395/2 |
| 5,228,088 | 7/1993 | Kane et al. | 381/47 |
| 5,247,579 | 9/1993 | Hardwick et al. | 381/40 |
| 5,265,167 | 11/1993 | Akamine et al. | 381/40 |
| 5,450,522 | 9/1995 | Hermansky et al. | 395/2.2 |

FOREIGN PATENT DOCUMENTS 154381 9/1985 European Pat. Off. .

OTHER PUBLICATIONS

"An Approximation to Voice Aperiodicity", Osamu Fujimura, *IEEE Transactions on Audio and Electroacoutics*, vol. AU-16, No. 1, (Mar. 1968).

"A Mixed-Source Model For Speech Compression And Synthesis", J. Makhoul, R. Viswanathan, R. Schwarts and A.W.F. Huggins, IEEE, (Jun. 1978).

"The JSRU channel vocoder", J.N. Holmes, M.Sc., F.I.O.A., C. Eng., F.I.E.E., IEE Proc., vol. 127, Pt. F, No. 1, (Feb. 1980).

"Voiced/Unvoiced/Mixed Excitation Classification of Speech", Leah J. Siegel, Alan C. Bessey, IEE Transactions On Acoustics, Speech, and Signal Processing, vol. ASSP-30, No. 3, (Jun. 1982).

"A 32-Band Sub-band/Transform Coder Incorporating Vector Quantization for Dynamic Bit Allocation", C.D. Heron R.E. Crochiere, R.V. Cox, IEEE, (Jun. 1983) ICASSP 83, Boston.

(List continued on next page.)

*Primary Examiner*—Allen R. Macdonald
*Assistant Examiner*—Richemond Dorvil
*Attorney, Agent, or Firm*—Fish & Richardson P.C.

[57] ABSTRACT

A method of encoding speech analyzes a digitized speech signal to determine excitation parameters for the digitized speech signal. The method includes dividing the digitized speech signal into at least two frequency bands, performing a nonlinear operation on at least one of the frequency bands to produce a modified frequency band, and determining whether the modified frequency band is voiced or unvoiced. The nonlinear operation is an operation that emphasizes a fundamental frequency of the digitized speech signal so that the modified frequency band signal includes a component corresponding to the fundamental frequency even when the at least one frequency band signal does not include such a component.

35 Claims, 2 Drawing Sheets

OTHER PUBLICATIONS

"Speech Analysis/Synthesis Based On Perception", James C. Anderson and Campbell L. Searle, IEEE, (Jun. 1983) ICASSP83 Boston.
"The Estimation And Evaluation Of Pointwise Nonlinearites For Improving The Performance Of Objective Speech Quality Measures", Schuyler R. Quackenbush and Thomas P. Barwnwell, III, IEEE, (Jun. 1983) ICASSP 83, Boston.
"A New System For Reliable Pitch Extraction Of Speech", Hiroya Fujisaki, Keikichi Hirose and Keisuke Shimizu, IEEE, (1987).
"Robust Pitch Detection In A Noisy Telephone Environment", Joseph Picone, George R. Doddington and Bruce G. Secrest, IEEE (1987).
"Auditory Neural Feedback As A Basis For Speech Processing", Oded Ghitza, IEEE, (Sep. 1988).
"A Robust Pitch Boundary Detector", C.S. Chen and Jing Yuan, IEEE, (Sep. 1988).
"Analysis of the Self-Excited Subband Coder: A New Approach to Medium Band Speech Coding", Kambiz Nayebi, Thomas P. Barnwell and Mark J.T. Smith, IEEE, (Sep. 1988).
"Speech Nonlinearities, Modulations, and Energy Operators", Petros Maragos, Thomas F. Quatieri, and James F. Kaiser, IEEE, (Jul. 1991).
"A Robust Real-Time Pitch Detector Based On Neural Networks", Horacio Marténez-Alfaro and Jos´L. Contreras-Vidal, IEEE, (Jul. 1991).
"Speech Coding Using Nonstationary Sinusoidal Modelling And Narrow-Band Bsis Function", Holger Carl and Bernd Kolpatzik, IEEE, (Jul. 1991).
"A New Mixed Excitation LPC Vocoder", Alan V. McCree and Thomas P. Barnwell III, IEEE, (Jul. 1991).
"A Robust 2400bit/s MBE-LPC Speech Coder Incorporating Joint Source and Channel Coding", D. Rowe and P. Secker IEEE, (Sep. 1992).
"Improving The Performance Of A Mixed Excitation LPC Vocoder In Acoustic Noise", Alan V. McCree and Thomas P. Barnwell III, IEEE, (Sep. 1992).
Campbell et al., "The New 4800 bps Voice Coding Standard," Mil Speech Tech Conference, Nov. 1989, pp. 64–70.
McAulay et al., "speech Analysis/Synthesis Based on a Simusoidal Representation," IEEE TASSP, vol. ASSP34, No. 4, Aug. 1986, pp. 744–754.
Griffin et al., "Multiband Excitation Vocoder", IEEE TASSP, vol. 36, No. 8, Aug. 1988, pp. 1223–1235.
McAuley et al., "Mid-Rate Coding Based on a Sinusoidal Representation of Speech," Proc. ICASSP 85, pp. 945–948, Tampa, Florida, Mar. 26–29, 1985.
Hardwick, "A 4.8 kbps Multi-Band Excitation Speech Coder", S.M. Thesis, MIT, May 1988.
Griffin et al., "A High Quality 9.6 kbps Speech Coding System", Proc. ICASSP 86, pp. 125–128, Tokyo, Japan Apr. 13–20, 1986.
Griffin, "Multi-Band Excitation Vocoder", Ph.D. Thesis, MIT, 1987.
Griffith et al., "A New Pitch Detection Algorithm", Digital Signal Processing, No. 84, pp. 395–399, 1984, Elsevier Science Publications.
Griffith et al., "A New Model-Based Speech Analysis/Synthesis System", IEEE International Conference on Acoustics, Speech, and Signal Processing, ICASSP 1985, pp. 513–516.
Griffin et al., "Signal Estimation from Modified Short-Time Fourier Transform", IEEE Transactions on Acoustics, Speech, and Signal Processing, vol. ASSP-32, No. 2, Apr. 1984, pp. 236–243.
Hardwick et al., "A 4.8 KBPS Multi-Band Excitiation Speech Coder", IEEE, ICASSP 88, vol. 1, Apr. 11–14, 1933, pp. 374–377.

ESTIMATION OF EXCITATION PARAMETERS

BACKGROUND OF THE INVENTION

The invention relates to improving the accuracy with which excitation parameters are estimated in speech analysis and synthesis.

Speech analysis and synthesis are widely used in applications such as telecommunications and voice recognition. A vocoder, which is a type of speech analysis/synthesis system, models speech as the response of a system to excitation over short time intervals. Examples of vocoder systems include linear prediction vocoders, homomorphic vocoders, channel vocoders, sinusoidal transform coders ("STC"), multiband excitation ("MBE") vocoders, and improved multiband excitation ("IMBE") vocoders.

Vocoders typically synthesize speech based on excitation parameters and system parameters. Typically, an input signal is segmented using, for example, a Hamming window. Then, for each segment, system parameters and excitation parameters are determined. System parameters include the spectral envelope or the impulse response of the system. Excitation parameters include a voiced/unvoiced decision, which indicates whether the input signal has pitch, and a fundamental frequency (or pitch). In vocoders that divide the speech into frequency bands, such as IMBE (TM) vocoders, the excitation parameters may also include a voiced/unvoiced decision for each frequency band rather than a single voiced/unvoiced decision. Accurate excitation parameters are essential for high quality speech synthesis.

Excitation parameters may also be used in applications, such as speech recognition, where no speech synthesis is required. Once again, the accuracy of the excitation parameters directly affects the performance of such a system.

SUMMARY OF THE INVENTION

In one aspect, generally, the invention features applying a nonlinear operation to a speech signal to emphasize the fundamental frequency of the speech signal and to thereby improve the accuracy with which the fundamental frequency and other excitation parameters are determined.

In typical approaches to determining excitation parameters, an analog speech signal s(t) is sampled to produce a speech signal s(n). Speech signal s(n) is then multiplied by a window w(n) to produce a windowed signal $s_w(n)$ that is commonly referred to as a speech segment or a speech frame. A Fourier transform is then performed on windowed signal $s_w(n)$ to produce a frequency spectrum $S_w(\omega)$ from which the excitation parameters are determined.

When speech signal s(n) is periodic with a fundamental frequency $\omega_o$ or pitch period $n_o$ (where $n_o$ equals $2\pi/\omega_o$), the frequency spectrum of speech signal s(n) should be a line spectrum with energy at $\omega_o$ and harmonics thereof (integral multiples of $\omega_o$). As expected, $S_w(\omega)$ has spectral peaks that are centered around $\omega_o$ and its harmonics. However, due to the windowing operation, the spectral peaks include some width, where the width depends on the length and shape of window w(n) and tends to decrease as the length of window w(n) increases. This window-induced error reduces the accuracy of the excitation parameters. Thus, to decrease the width of the spectral peaks, and to thereby increase the accuracy of the excitation parameters, the length of window w(n) should be made as long as possible.

The maximum useful length of window w(n) is limited. Speech signals are not stationary signals, and instead have fundamental frequencies that change over time. To obtain meaningful excitation parameters, an analyzed speech segment must have a substantially unchanged fundamental frequency. Thus, the length of window w(n) must be short enough to ensure that the fundamental frequency will not change significantly within the window.

In addition to limiting the maximum length of window w(n), a changing fundamental frequency tends to broaden the spectral peaks. This broadening effect increases with increasing frequency. For example, if the fundamental frequency changes by $\Delta\omega_o$ during the window, the frequency of the $m^{th}$ harmonic, which has a frequency of $m\omega_o$, changes by $m\Delta\omega_o$ so that the spectral peak corresponding to $m\omega_o$ is broadened more than the spectral peak corresponding to $\omega_o$. This increased broadening of the higher harmonics reduces the effectiveness of higher harmonics in the estimation of the fundamental frequency and the generation of voiced/unvoiced decisions for high frequency bands.

By applying a nonlinear operation, the increased impact on higher harmonics of a changing fundamental frequency is reduced or eliminated, and higher harmonics perform better in estimation of the fundamental frequency and determination of voiced/unvoiced decisions. Suitable nonlinear operations map from complex (or real) to real values and produce outputs that are nondecreasing functions of the magnitudes of the complex (or real) values. Such operations include, for example, the absolute value, the absolute value squared, the absolute value raised to some other power, or the log of the absolute value.

Nonlinear operations tend to produce output signals having spectral peaks at the fundamental frequencies of their input signals. This is true even when an input signal does not have a spectral peak at the fundamental frequency. For example, if a bandpass filter that only passes frequencies in the range between the third and fifth harmonics of $\omega_o$ is applied to a speech signal s(n), the output of the bandpass filter, x(n), will have spectral peaks at $3\omega_o$, $4\omega_o$, and $5\omega_o$.

Though x(n) does not have a spectral peak at $\omega_o$, $|x(n)|^2$ will have such a peak. For a real signal x(n), $|x(n)|^2$ is equivalent to $x^2(n)$. As is well known, the Fourier transform of $x^2(n)$ is the convolution of $X(\omega)$, the Fourier transform of x(n), with $X(\omega)$:

$$\sum_{n=-\infty}^{\infty} x^2(n)e^{-j\omega n} = \frac{1}{2\pi}\int_{u=-\pi}^{\pi} X(\omega-u)X(u)du.$$

The convolution of $X(\omega)$ with $X(\omega)$ has spectral peaks at frequencies equal to the differences between the frequencies for which $X(\omega)$ has spectral peaks. The differences between the spectral peaks of a periodic signal are the fundamental frequency and its multiples. Thus, in the example in which $X(\omega)$ has spectral peaks at $3\omega_o$, $4\omega_o$, and $5\omega_o$, $X(\omega)$ convolved with $X(\omega)$ has a spectral peak at $\omega_o$ ($4\omega_o-3\omega_o$, $5\omega_o-4\omega_o$). For a typical periodic signal, the spectral peak at the fundamental frequency is likely to be the most prominent.

The above discussion also applies to complex signals. For a complex signal x(n), the Fourier transform of $|x(n)|^2$ is:

$$\sum_{n=-\infty}^{\infty} |x(n)|^2 e^{-j\omega n} = \frac{1}{2\pi}\int_{u=-\pi}^{\pi} X(\omega+u)X^*(u)du.$$

This is an autocorrelation of $X(\omega)$ with $X^*(\omega)$, and also has the property that spectral peaks separated by $n\omega_o$ produce peaks at $n\omega_o$.

Even though $|x(n)|$, $|x(n)|^a$ for some real "a", and $\log |x(n)|$ are not the same as $|x(n)|^2$, the discussion above for $|x(n)|^2$ applies approximately at the qualitative level. For example, for $|x(n)|=y(n)^{0.5}$, where $y(n)=|x(n)|^2$, a Taylor series expansion of y(n) can be expressed as:

$$|x(n)| = \sum_{k=0}^{\infty} c_k y^k(n).$$

Because multiplication is associative, the Fourier transform of the signal $y^k(n)$ is $Y(\omega)$ convolved with the Fourier transform of $y^{k-1}(n)$. The behavior for nonlinear operations other than $|x(n)|^2$ can be derived from $|x(n)|^2$ by observing the behavior of multiple convolutions of $Y(\omega)$ with itself. If $Y(\omega)$ has peaks at $n\omega_o$, then multiple convolutions of $Y(\omega)$ with itself will also have peaks at $n\omega_o$.

As shown, nonlinear operations emphasize the fundamental frequency of a periodic signal, and are particularly useful when the periodic signal includes significant energy at higher harmonics.

According to the invention, excitation parameters for an input signal are generated by dividing the input signal into at least two frequency band signals. Thereafter, a nonlinear operation is performed on at least one of the frequency band signals to produce at least one modified frequency band signal. Finally, for each modified frequency band signal, a determination is made as to whether the modified frequency band signal is voiced or unvoiced. Typically, the voiced/unvoiced determination is made, at regular intervals of time.

To determine whether a modified frequency band signal is voiced or unvoiced, the voiced energy (typically the portion of the total energy attributable to the estimated fundamental frequency of the modified frequency band signal and any harmonics of the estimated fundamental frequency) and the total energy of the modified frequency band signal are calculated. Usually, the frequencies below $0.5\omega_o$ are not included in the total energy, because including these frequencies reduces performance. The modified frequency band signal is declared to be voiced when the voiced energy of the modified frequency band signal exceeds a predetermined percentage of the total energy of the modified frequency band signal, and otherwise declared to be unvoiced. When the modified frequency band signal is declared to be voiced, a degree of voicing is estimated based on the ratio of the voiced energy to the total energy. The voiced energy can also be determined from a correlation of the modified frequency band signal with itself or another modified frequency band signal.

To reduce computational overhead or to reduce the number of parameters, the set of modified frequency band signals can be transformed into another, typically smaller, set of modified frequency band signals prior to making voiced/unvoiced determinations. For example, two modified frequency band signals from the first set can be combined into a single modified frequency band signal in the second set.

The fundamental frequency of the digitized speech can be estimated. Often, this estimation involves combining a modified frequency band signal with at least one other frequency band signal (which can be modified or unmodified), and estimating the fundamental frequency of the resulting combined signal. Thus, for example, when nonlinear operations are performed on at least two of the frequency band signals to produce at least two modified frequency band signals, the modified frequency band signals can be combined into one signal, and an estimate of the fundamental frequency of the signal can be produced. The modified frequency band signals can be combined by summing. In another approach, a signal-to-noise ratio can be determined for each of the modified frequency band signals, and a weighted combination can be produced so that a modified frequency band signal with a high signal-to-noise ratio contributes more to the signal than a modified frequency band signal with a low signal-to-noise ratio.

In another aspect, generally, the invention features using nonlinear operations to improve the accuracy of fundamental frequency estimation. A nonlinear operation is performed on the input signal to produce a modified signal from which the fundamental frequency is estimated. In another approach, the input signal is divided into at least two frequency band signals. Next, a nonlinear operation is performed on these frequency band signals to produce modified frequency band signals. Finally, the modified frequency band signals are combined to produce a combined signal from which a fundamental frequency is estimated.

Other features and advantages of the invention will be apparent from the following description of the preferred embodiments and from the claims.

DESCRIPTION OF THE PREFERRED EMBODIMENTS

FIGS. 1–5 show the structure of a system for determining whether frequency bands of a signal are voiced or unvoiced, the various blocks and units of which are preferably implemented with software.

Figure 1:
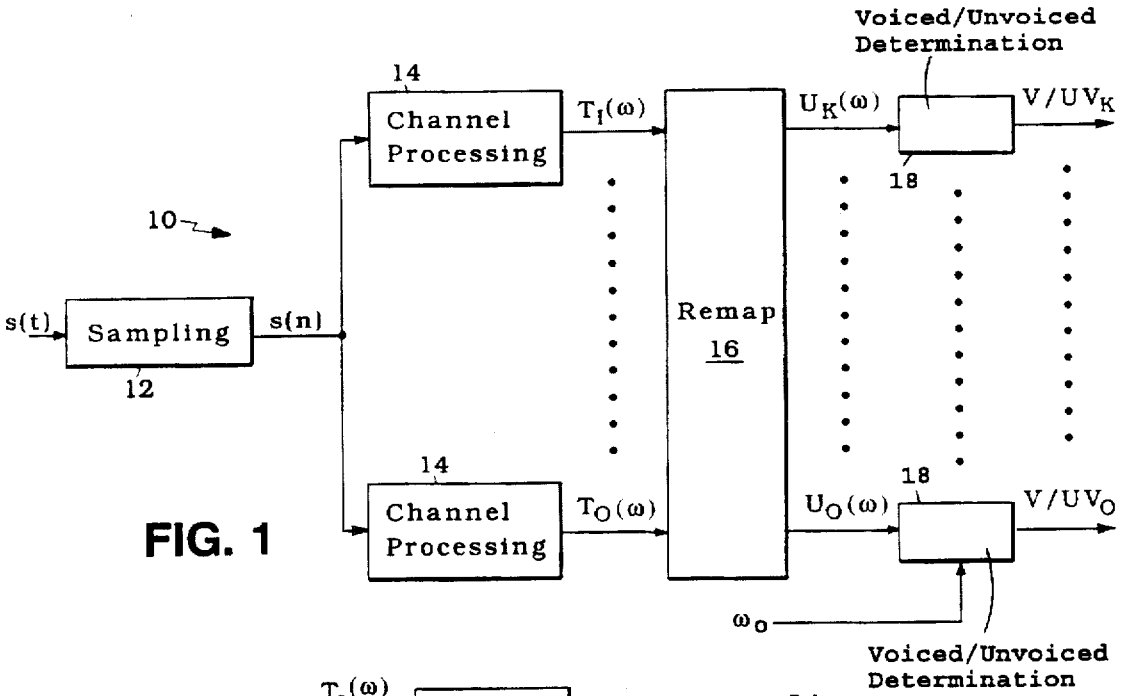
FIG. 1 is a block diagram of a system for determining whether frequency bands of a signal are voiced or unvoiced.

Referring to FIG. 1, in a voiced/unvoiced determination system 10, a sampling unit 12 samples an analog speech signal s(t) to produce a speech signal s(n). For typical speech coding applications, the sampling rate ranges between six kilohertz and ten kilohertz.

Channel processing units 14 divide speech signal s(n) into at least two frequency bands and process the frequency bands to produce a first set of frequency band signals, designated as $T_0(\omega) \ldots T_I(\omega)$. As discussed below, channel processing units 14 are differentiated by the parameters of a bandpass filter used in the first stage of each channel processing unit 14. In the preferred embodiment, there are sixteen channel processing units (I equals 15).

A remap unit 16 transforms the first set of frequency band signals to produce a second set of frequency band signals, designated as $U_0(\omega) \ldots U_K(\omega)$. In the preferred embodiment, there are eleven frequency band signals in the second set of frequency band signals (K equals 10). Thus, remap unit 16 maps the frequency band signals from the sixteen channel processing units 14 into eleven frequency band signals. Remap unit 16 does so by mapping the low frequency components $(T_0(\omega) \ldots T_5(\omega))$ of the first set of frequency bands signals directly into the second set of frequency band signals $(U_0(\omega) \ldots U_5(\omega))$. Remap unit 16 then combines the remaining pairs of frequency band signals from the first set into single frequency band signals in the second set. For example, $T_6(\omega)$ and $T_7(\omega)$ are combined to produce $U_6(\omega)$, and $T_{14}(\omega)$ and $T_{15}(\omega)$ are combined to produce $U_{10}(\omega)$. Other approaches to remapping could also be used.

Next, voiced/unvoiced determination units 18, each associated with a frequency band signal from the second set, determine whether the frequency band signals are voiced or unvoiced, and produce output signals ($V/UV_0 \ldots V/UV_K$) that indicate the results of these determinations. Each determination unit 18 computes the ratio of the voiced energy of its associated frequency band signal to the total energy of that frequency band signal. When this ratio exceeds a predetermined threshold, determination unit 18 declares the frequency band signal to be voiced. Otherwise, determination unit 18 declares the frequency band signal to be unvoiced.

Determination units 18 compute the voiced energy of their associated frequency band signals as:

$$E_{kV}(\omega_o) = \sum_{n=1}^{N} \sum_{\omega_m \in I_n} U_k(\omega_m)$$

where $$I_n = [(n - 0.25)\omega_o, (n + 0.25)\omega_o],$$

$\omega_o$ is an estimate of the fundamental frequency (generated as described below), and N is the number of harmonics of the fundamental frequency $\omega_o$ being considered. Determination units 18 compute the total energy of their associated frequency band signals as follows:

$$E_{kT}(\omega_o) = \sum_{\omega_m \geqq 0.5\omega_o} U_k(\omega_m).$$

In another approach, rather than just determining whether the frequency band signals are voiced or unvoiced, determination units 18 determine the degree to which a frequency band signal is voiced. Like the voiced/unvoiced decision discussed above, the degree of voicing is a function of the ratio of voiced energy to total energy: when the ratio is near one, the frequency band signal is highly voiced; when the ratio is less than or equal to a half, the frequency band signal is highly unvoiced; and when ratio is between a half and one, the frequency band signal is voiced to a degree indicated by the ratio.

Figure 2:
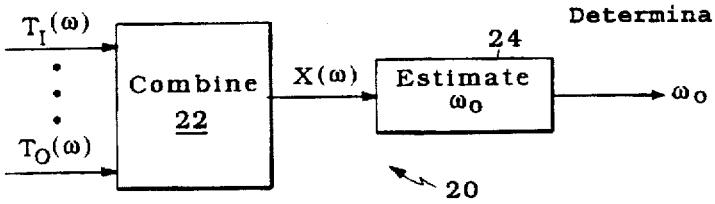
FIGS. 2–3 are block diagrams of fundamental frequency estimation units.

Referring to FIG. 2, a fundamental frequency estimation unit 20 includes a combining unit 22 and an estimator 24. Combining unit 22 sums the $T_i(\omega)$ outputs of channel processing units 14 (FIG. 1) to produce $X(\omega)$. In an alternative approach, combining unit 22 could estimate a signal-to-noise ratio (SNR) for the output of each channel processing unit 14 and weigh the various outputs so that an output with a higher SNR contributes more to $X(\omega)$ than does an output with a lower SNR.

Estimator 24 then estimates the fundamental frequency ($\omega_o$) by selecting a value for $\omega_o$ that maximizes $X(\omega_o)$ over an interval from $\omega_{min}$ to $\omega_{max}$. Since $X(\omega)$ is only available at discrete samples of $\omega$, parabolic interpolation of $X(\omega_o)$ near $\omega_o$ is used to improve accuracy of the estimate. Estimator 24 further improves the accuracy of the fundamental estimate by combining parabolic estimates near the peaks of the N harmonics of $\omega_o$ within the bandwidth of $X(\omega)$.

Once an estimate of the fundamental frequency is determined, the voiced energy $E_v(\omega_o)$ is computed as:

$$E_v(\omega_o) = \sum_{n=1}^{N} \sum_{\omega_m \in I_n} X(\omega_m)$$

where

-continued $$I_n = [(n - 0.25)\omega_o, (n + 0.25)\omega_o].$$

Thereafter, the voiced energy $E_v(0.5\omega_o)$ is computed and compared to $E_v(\omega_o)$ to select between $\omega_o$ and $0.5\omega_o$ as the final estimate of the fundamental frequency.

Figure 3:
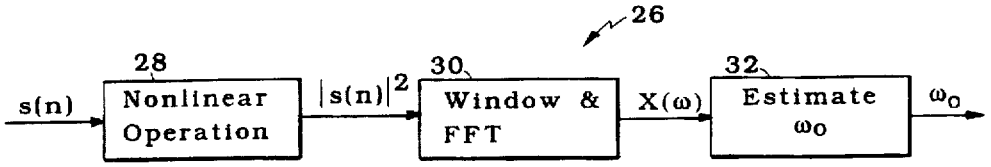

Referring to FIG. 3, an alternative fundamental frequency estimation unit 26 includes a nonlinear operation unit 28, a windowing and Fast Fourier Transform (FFT) unit 30, and an estimator 32. Nonlinear operation unit 28 performs a nonlinear operation, the absolute value squared, on s(n) to emphasize the fundamental frequency of s(n) and to facilitate determination of the voiced energy when estimating $\omega_o$.

Windowing and FFT unit 30 multiplies the output of nonlinear operation unit 28 to segment it and computes an FFT, $X(\omega)$, of the resulting product. Finally, an estimator 32, which works identically to estimator 24, generates an estimate of the fundamental frequency.

Figure 4:
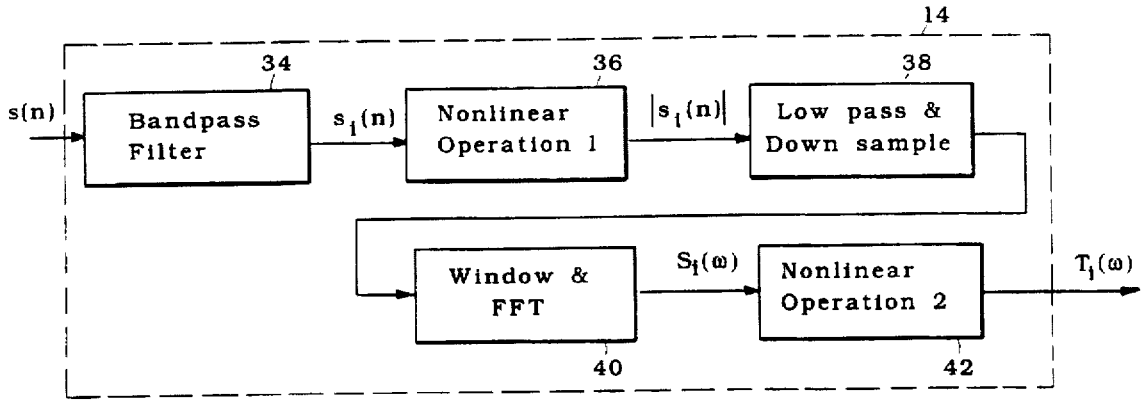
FIG. 4 is a block diagram of a channel processing unit of the system of FIG. 1.
Figure 5:
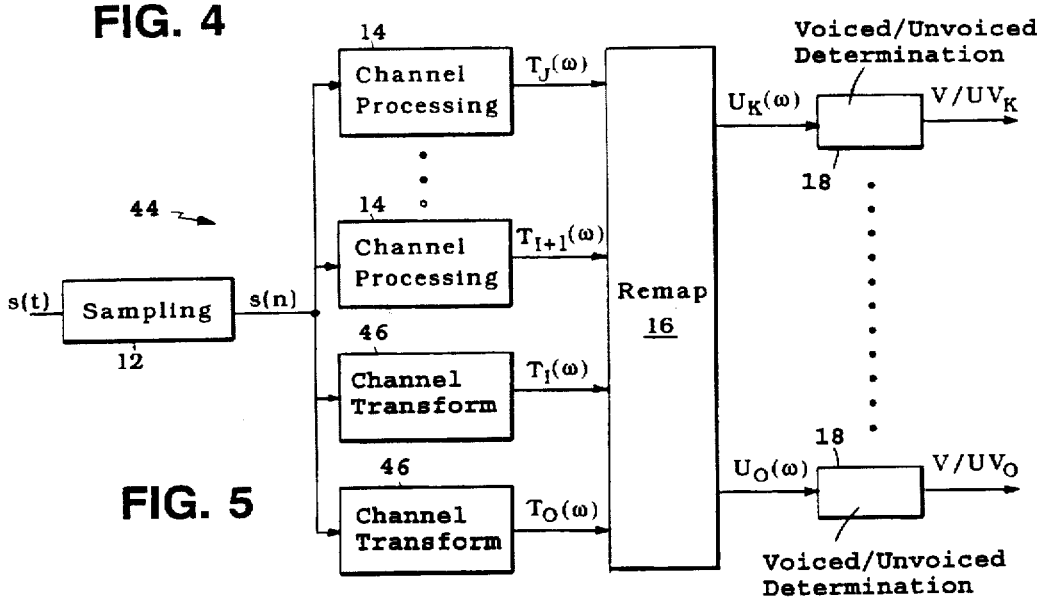
FIG. 5 is a block diagram of a system for determining whether frequency bands of a signal are voiced or unvoiced.

Referring to FIG. 4, when speech signal s(n) enters a channel processing unit 14, components $s_i(n)$ belonging to a particular frequency band are isolated by a bandpass filter 34. Bandpass filter 34 uses downsampling to reduce computational requirements, and does so without any significant impact on system performance. Bandpass filter 34 can be implemented as a Finite Impulse Response (FIR) or Infinite Impulse Response (IIR) filter, or by using an FFT. Bandpass filter 34 is implemented using a thirty two point real input FFT to compute the outputs of a thirty two point FIR filter at seventeen frequencies, and achieves downsampling by shifting the input speech samples each time the FFT is computed. For example, if a first FFT used samples one through thirty two, a downsampling factor of ten would be achieved by using samples eleven through forty two in a second FFT.

A first nonlinear operation unit 36 then performs a nonlinear operation on the isolated frequency band $s_i(n)$ to emphasize the fundamental frequency of the isolated frequency band $s_i(n)$. For complex values of $s_i(n)$ (i greater than zero), the absolute value, $|s_i(n)|$, is used. For the real value of $s_0(n)$, $s_0(n)$ is used if $s_0(n)$ is greater than zero and zero is used if $s_0(n)$ is less than or equal to zero.

The output of nonlinear operation unit 36 is passed through a lowpass filtering and downsampling unit 38 to reduce the data rate and consequently reduce the computational requirements of later components of the system. Lowpass filtering and downsampling unit 38 uses a seven point FIR filter computed every other sample for a downsampling factor of two.

A windowing and FFT unit 40 multiplies the output of lowpass filtering and downsampling unit 38 by a window and computes a real input FFT, $S_i(\omega)$, of the product.

Finally, a second nonlinear operation unit 42 performs a nonlinear operation on $S_i(\omega)$ to facilitate estimation of voiced or total energy and to ensure that the outputs of channel processing units 14, $T_i(\omega)$, combine constructively if used in fundamental frequency estimation. The absolute value squared is used because it makes all components of $T_i(\omega)$ real and positive.

Other embodiments are within the following claims. For example, referring to FIG. 5, an alternative voiced/unvoiced determination system 44, includes a sampling unit 12, channel processing units 14, a remap unit 16, and voiced/unvoiced determination units 18 that operate identically to the corresponding units in voiced/unvoiced determination system 10. However, because nonlinear operations are most advantageously applied to high frequency bands, determination system 44 only uses channel processing units 14 in frequency bands corresponding to high frequencies, and uses channel transform units 46 in frequency bands corresponding to low frequencies. Channel transform units 46, rather than applying nonlinear operations to an input signal, process the input signal according to well known techniques for generating frequency band signals. For example, a channel transform unit 46 could include a bandpass filter and a window and FFT unit.

In an alternate approach, the window and FFT unit 40 and the nonlinear operation unit 42 of FIG. 4 could be replaced by a window and autocorrelation unit. The voiced energy and total energy would then be computed from the autocorrelation.

What is claimed is:

1. A method of analyzing a digitized speech signal to determine excitation parameters for the digitized speech signal, comprising the steps of:

dividing the digitized speech signal into at least two frequency band signals;

performing a nonlinear operation on at least one of the frequency band signals to produce at least one modified frequency band signal, wherein the nonlinear operation is an operation that emphasizes a fundamental frequency of the digitized speech signal so that the modified frequency band signal includes a component corresponding to the fundamental frequency even when the at least one frequency band signal does not include such a component; and for at least one modified frequency band signal, determining whether the modified frequency band signal is voiced or unvoiced.

2. The method of claim 1, wherein the determining step is performed at regular intervals of time.

3. The method of claim 1, wherein the digitized speech signal is analyzed as a step in encoding speech.

4. The method of claim 1, further comprising the step of estimating the fundamental frequency of the digitized speech.

5. The method of claim 1, further comprising the step of estimating the fundamental frequency of at least one modified frequency band signal.

6. The method of claim 1, further comprising the steps of:

combining a modified frequency band signal with at least one other frequency band signal to produce a combined signal; and estimating the fundamental frequency of the combined signal.

7. The method of claim 6, wherein the performing step is performed on at least two of the frequency band signals to produce at least two modified frequency band signals, and said combining step comprises combining at least the two modified frequency band signals.

8. The method of claim 6, wherein the combining step includes summing the modified frequency band signal and the at least one other frequency band signal to produce the combined signal.

9. The method of claim 6, further comprising the step of determining a signal-to-noise ratio for the modified frequency band signal and the at least one other frequency band signal, and wherein said combining step includes weighing the modified frequency band signal and the at least one other frequency band signal to produce the combined signal so that a frequency band signal with a high signal-to-noise ratio contributes more to the combined signal than a frequency band signal with a low signal-to-noise ratio.

10. The method of claim 6, wherein said determining step includes:

determining the voiced energy of the modified frequency band signal;

determining the total energy of the modified frequency band signal;

declaring the modified frequency band signal to be voiced when the voiced energy of the modified frequency band signal exceeds a predetermined percentage of the total energy of the modified frequency band signal; and declaring the modified frequency band signal to be unvoiced when the voiced energy of the modified frequency band signal is equal or less than the predetermined percentage of the total energy of the modified frequency band signal.

11. The method of claim 10, wherein the voiced energy is the portion of the total energy attributable to the estimated fundamental frequency of the modified frequency band signal and any harmonics of the estimated fundamental frequency.

12. The method of claim 1, wherein said determining step includes:

determining the voiced energy of the modified frequency band signal;

determining the total energy of the modified frequency band signal;

declaring the modified frequency band signal to be voiced when the voiced energy of the modified frequency band signal exceeds a predetermined percentage of the total energy of the modified frequency band signal; and declaring the modified frequency band signal to be unvoiced when the voiced energy of the modified frequency band signal is equal or less than the predetermined percentage of the total energy of the modified frequency band signal.

13. The method of claim 12, wherein the voiced energy of the modified frequency band signal is derived from a correlation of the modified frequency band signal with itself or another modified frequency band signal.

14. The method of claim 12, wherein, when said modified frequency band signal is declared to be voiced, said determining step further includes estimating a degree of voicing for the modified frequency band signal by comparing the voiced energy of the modified frequency band signal to the total energy of the modified frequency band signal.

15. The method of claim 1, wherein said performing step includes performing a nonlinear operation on all of the frequency band signals so that the number of modified frequency band signals produced by said performing step equals the number of frequency band signals produced by said dividing step.

16. The method of claim 1, wherein said performing step includes performing a nonlinear operation on only some of the frequency band signals so that the number of modified frequency band signals produced by said performing step is less than the number of frequency band signals produced by said dividing step.

17. The method of claim 16, wherein the frequency band signals on which a nonlinear operation is performed correspond to higher frequencies than the frequency band signals on which a nonlinear operation is not performed.

18. The method of claim 17, further comprising the step of, for frequency band signals on which a nonlinear operation is not performed, determining whether the frequency band signal is voiced or unvoiced.

19. The method of claim 1, wherein the nonlinear operation is the absolute value.

20. The method of claim 1, wherein the nonlinear operation is the absolute value squared.

21. The method of claim 1, wherein the nonlinear operation is the absolute value raised to a power corresponding to a real number.

22. The method of claim 1, further comprising the steps of:

performing a nonlinear operation on at least two of the frequency band signals to produce a first set of modified frequency band signals;

transforming the first set of modified frequency band signals into a second set of at least one modified frequency band signal;

for at least one modified frequency band signal in the second set, determining whether the modified frequency band signal is voiced or unvoiced.

23. The method of claim 22, wherein said transforming step includes combining at least two modified frequency band signals from the first set to produce a single modified frequency band signal in the second set.

24. The method of claim 22, further comprising the step of estimating the fundamental frequency of the digitized speech.

25. The method of claim 22, further comprising the steps of:

combining a modified frequency band signal from the second set of modified frequency band signals with at least one other frequency band signal to produce a combined signal; and estimating the fundamental frequency of the combined signal.

26. The method of claim 22, wherein said determining step includes:

determining the voiced energy of the modified frequency band signal;

determining the total energy of the modified frequency band signal;

declaring the modified frequency band signal to be voiced when the voiced energy of the modified frequency band signal exceeds a predetermined percentage of the total energy of the modified frequency band signal; and declaring the modified frequency band signal to be unvoiced when the voiced energy of the modified frequency band signal is equal or less than the predetermined percentage of the total energy of the modified frequency band signal.

27. The method of claim 26, wherein, when said modified frequency band signal is declared to be voiced, said determining step further includes estimating a degree of voicing for the modified frequency band signal by comparing the voiced energy of the modified frequency band signal to the total energy of the modified frequency band signal.

28. The method of claim 1, further comprising the step of encoding some of the excitation parameters.

29. A method of analyzing a digitized speech signal to determine excitation parameters for the digitized speech signal, comprising the steps of:

dividing the digitized speech signal into at least two frequency band signals;

performing a nonlinear operation on a first one of the frequency band signals to produce a first modified frequency band signal, wherein the nonlinear operation is an operation that emphasizes a fundamental frequency of the digitized speech signal so that the first modified frequency band signal includes a component corresponding to the fundamental frequency even when the first one of the frequency band signals does not include such a component;

combining the first modified frequency band signal and at least one other frequency band signal to produce a combined frequency band signal; and estimating the fundamental frequency of the combined frequency band signal.

30. A method of analyzing a digitized speech signal to determine excitation parameters for the digitized speech signal, comprising the steps of:

dividing the digitized speech signal into at least two frequency band signals;

performing a nonlinear operation on at least one of the frequency band signals to produce at least one modified band signal, wherein the nonlinear operation is an operation that emphasizes a fundamental frequency of the digitized speech signal so that the modified frequency band signal includes a component corresponding to the fundamental frequency even when the at least one of the frequency band signals does not include such a component; and estimating the fundamental frequency from at least one modified band signal.

31. A method of analyzing a digitized speech signal to determine the fundamental frequency for the digitized speech signal, comprising the steps of:

dividing the digitized speech signal into at least two frequency band signals;

performing a nonlinear operation on at least two of the frequency band signals to produce at least two modified frequency band signals, wherein the nonlinear operation is an operation that emphasizes a fundamental frequency of the digitized speech signal so that the modified frequency band signals include a component corresponding to the fundamental frequency even when the corresponding frequency band signal does not include such a component;

combining the at least two modified frequency band signals to produce a combined signal; and estimating the fundamental frequency of the combined signal.

32. A system for encoding speech by analyzing a digitized speech signal to determine excitation parameters for the digitized speech signal, comprising:

means for dividing the digitized speech signal into at least two frequency band signals;

means for performing a nonlinear operation on at least one of the frequency band signals to produce at least one modified frequency band signal, wherein the nonlinear operation is an operation that emphasizes a fundamental frequency of the digitized speech signal so that the modified frequency band signal includes a component corresponding to the fundamental frequency even when the at least one frequency band signal does not include such a component; and means for determining, for at least one modified frequency band signal, whether the modified frequency band signal is voiced or unvoiced.

33. The system of claim 32, further comprising:

means for combining the at least one modified frequency band signal with at least one other frequency band signal to produce a combined signal; and means for estimating the fundamental frequency of the combined signal.

34. The system of claim 32, wherein the means for performing includes means for performing a nonlinear operation on only some of the frequency band signals so that the number of modified frequency band signals produced by the means for performing is less than the number of frequency band signals produced by the means for dividing.

35. The system of claim 34, wherein the frequency band signals on which the performing means performs a nonlinear operation correspond to higher frequencies than the frequency band signals on which the performing means does not perform a nonlinear operation.

* * * * *

UNITED STATES PATENT AND TRADEMARK OFFICE

CERTIFICATE OF CORRECTION

PATENT NO. : 5,715,365

DATED : February 3, 1998

INVENTOR(S) : Daniel Wayne Griffin and Jae S. Lim

It is certified that error appears in the above-identified patent and that said Letters Patent is hereby corrected as shown below:

Cover page , [56] References Cited, U.S. PATENT DOCUMENTS, at the "4,091,237" reference, "Wolniwsky et al." should be --Wolnowsky et al.--.

Cover page 2, column 1, [56] References Cited, OTHER PUBLICATIONS, at "'A Robust Real-Time...'" reference, "Jos''" should be --José--.

Cover page 2, column 1, [56] References Cited, OTHER PUBLICATIONS, at "'Speech Coding Using...'" reference, "Bsis" should be --Basis--.

Cover page 2, column 2, [56] References Cited, OTHER PUBLICATIONS, at first occurrence "McAulay et al." reference, "Simusoidal" should be --Sinusoidal--.

Signed and Sealed this

Ninth Day of June, 1998

*Attest:*

Bruce Lehman

BRUCE LEHMAN

*Attesting Officer*

*Commissioner of Patents and Trademarks*